US006913249B1

(12) United States Patent
Lerdu

(10) Patent No.: US 6,913,249 B1
(45) Date of Patent: Jul. 5, 2005

(54) FENCE

(76) Inventor: Jean-Michel Lerdu, 120 S. Central Ave., Clayton, MO (US) 63105

( * ) Notice: Subject to any disclaimer, the term of this patent is extended or adjusted under 35 U.S.C. 154(b) by 175 days.

(21) Appl. No.: 10/033,178

(22) Filed: Dec. 28, 2001

Related U.S. Application Data

(60) Provisional application No. 60/260,051, filed on Jan. 5, 2001.

(51) Int. Cl.[7] ..... E04H 17/16

(52) U.S. Cl. ..... 256/24; 256/65.02; 256/65.08; 256/65.11

(58) Field of Search ..... 256/1, 19, 22, 256/24, 59, 65.02, 65.08, 65.11, 65.03, 68, 256/65.12, 65.04, 65.01; 403/326, 329, 373, 403/315, 316, 317

(56) References Cited

U.S. PATENT DOCUMENTS 1,376,150 A * 4/1921 Miller ..... 403/230
2,588,147 A * 3/1952 Morris ..... 256/73
3,482,819 A * 12/1969 Leurent ..... 256/59
3,955,799 A * 5/1976 Lauzier ..... 256/21
3,975,000 A * 8/1976 Sado ..... 256/59
4,010,520 A * 3/1977 Yoshida ..... 24/411
4,346,872 A * 8/1982 Tornya ..... 256/65.02
4,421,302 A * 12/1983 Grimm et al. ..... 256/59 X
4,953,830 A * 9/1990 Weaver, III ..... 256/65.02
4,962,914 A * 10/1990 Taylor ..... 256/72
5,702,090 A * 12/1997 Edgman ..... 256/19
5,938,184 A * 8/1999 DeSouza ..... 256/19
6,231,031 B1 * 5/2001 Michael et al. ..... 256/65.02
6,367,213 B1 * 4/2002 Reuter et al.

* cited by examiner

*Primary Examiner*—William L. Miller

(57) ABSTRACT

A fence which includes upper and lower horizontal rails with boards extending between the rails. The rails are formed into separable half parts which are connectable together about the boards. The half parts include opposing ribs which separate the boards.

17 Claims, 10 Drawing Sheets

FENCE

CROSS-REFERENCE TO RELATED APPLICATION

This application claims the benefit of U.S. Provisional Application No. 60/260,051, filed Jan. 5, 2001.

SUMMARY OF THE INVENTION

This invention relates to a fence and will have particular but not limited application to a fence formed with substantially extruded plastic materials.

In this invention, the fence includes an upper horizontal rail and a lower horizontal rail with boards extending between the rails. At least one of the rails is formed by separable half parts with each part including a cooperating fastener for securing the parts together about the boards. At least one, and preferably both, of the joined half parts, are formed with protruding ribs which form spacers extending between the boards. A space is formed between adjacent paired ribs of the joined half parts which permits a board to be fitted between the parts and separated from the adjacent board by a protruding rib.

Accordingly, it is an object of this invention to provide a fence which is of simple manufacture and assembly.

Another object of this invention is to provide a fence which can be rapidly and easily assembled and installed.

Still, a further object of this invention is to provide a fence which is of durable and economical construction.

Other objects of this invention become apparent upon the reading of the following description.

BRIEF DESCRIPTION OF THE DRAWINGS

The following described drawings relate to the invention as follows.

DESCRIPTION OF THE PREFERRED EMBODIMENTS

Figure 1:
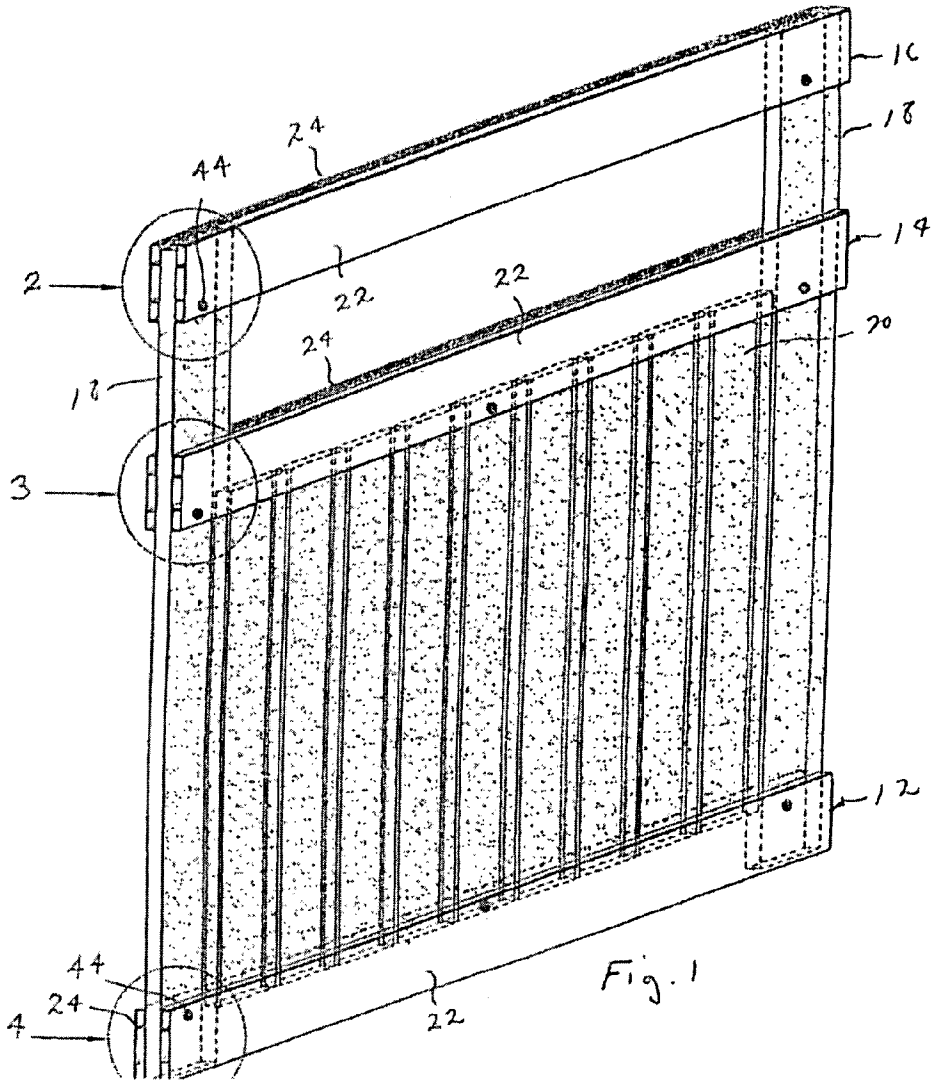
FIG. 1 is a perspective view of one embodiment of this invention.

The preferred embodiments illustrated are not exhaustive or intended to limit the invention to the precise forms disclosed. They are chosen to better describe the invention to enable one skilled in the art to best utilize the invention.

Fence 10 illustrated in FIGS. 1–6 includes a bottom rail 12, an intermediate rail 14, and a top rail 16. Interconnecting rails 12, 14 and 16 are end posts 18. Extending between bottom rail 12 and intermediate rail 14 are of boards 20. In some constructions of this invention, the use of top rail 16 would be eliminated with only rails 12 and 14 being utilized to retain boards 20. (See FIG. 13).

Figure 5:
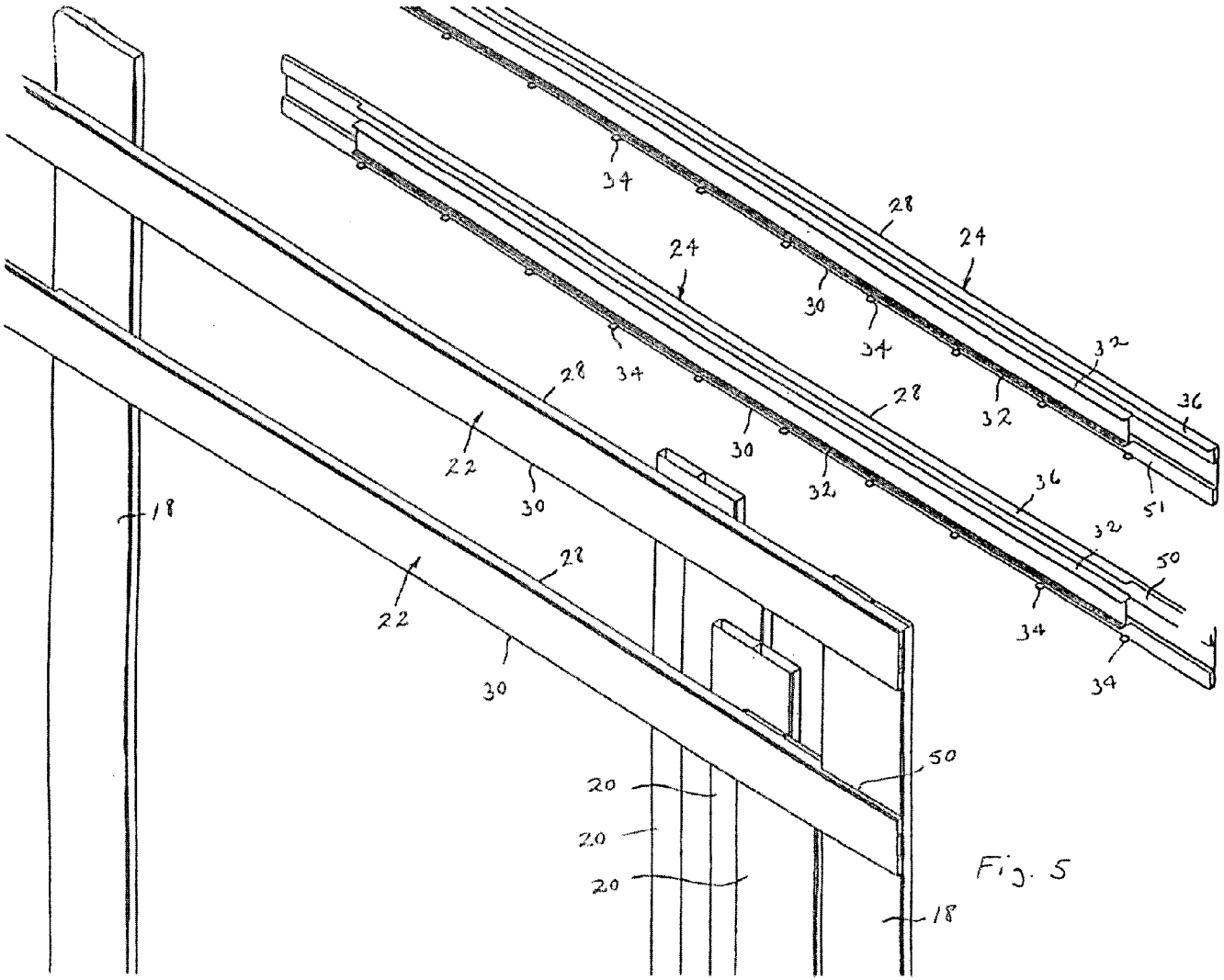
FIG. 5 is a perspective view in fragmentary form of the upper portion of the fence of FIG. 1 with the components thereof separated for purposes of illustration.
Figure 6:
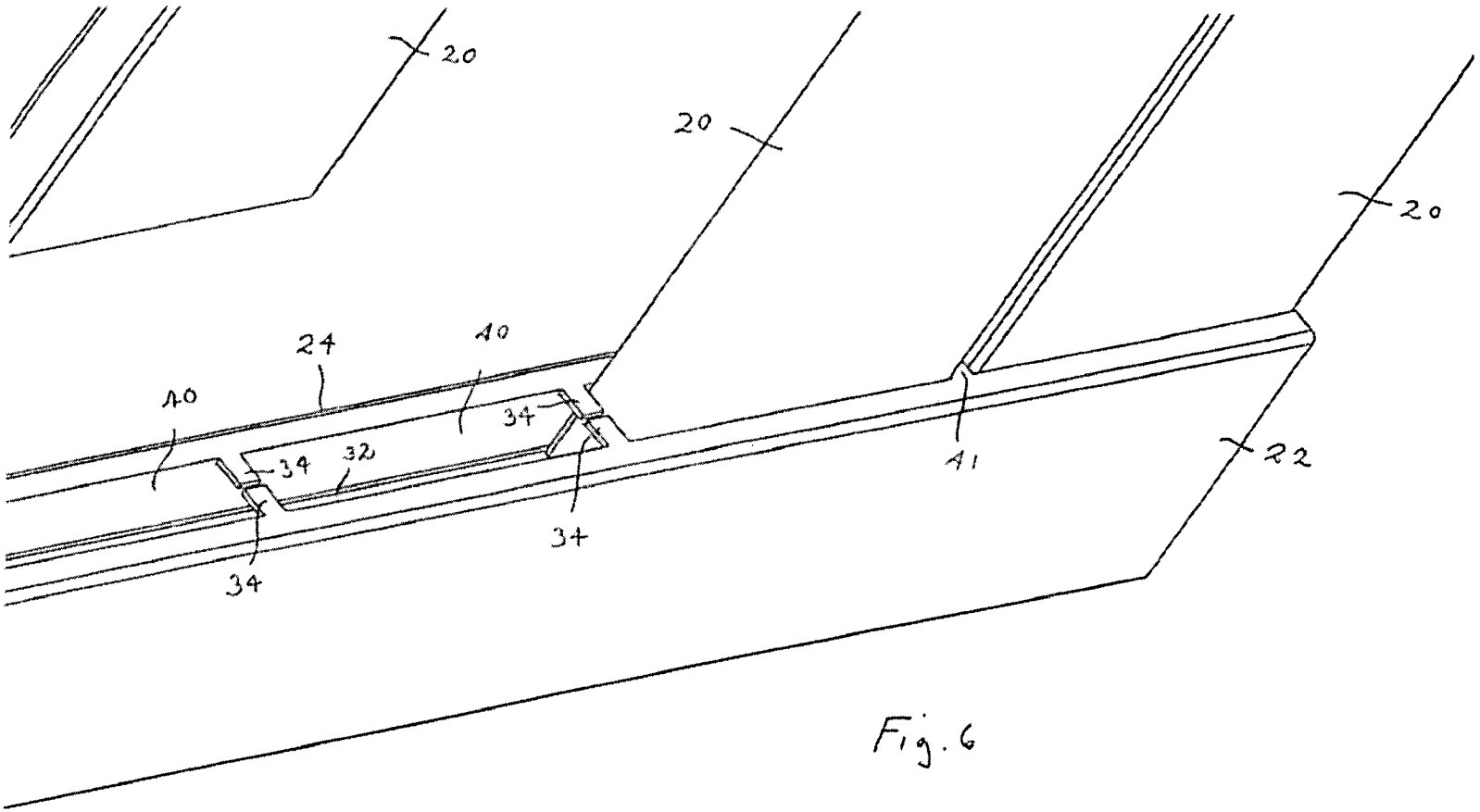
FIG. 6 is a fragmentary perspective view of the lower portion of the fence of FIG. 1.
Figure 10:
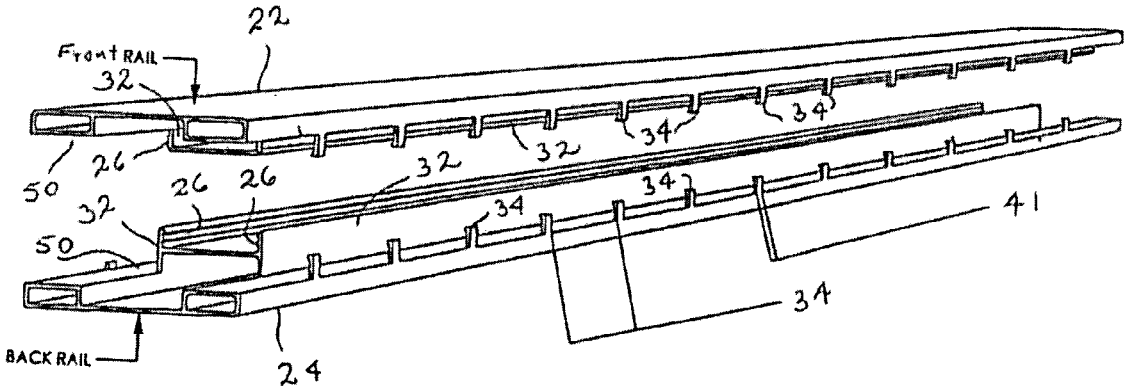
FIG. 10 is a perspective view of the separated half parts illustrated in FIG. 9.
Figure 17:
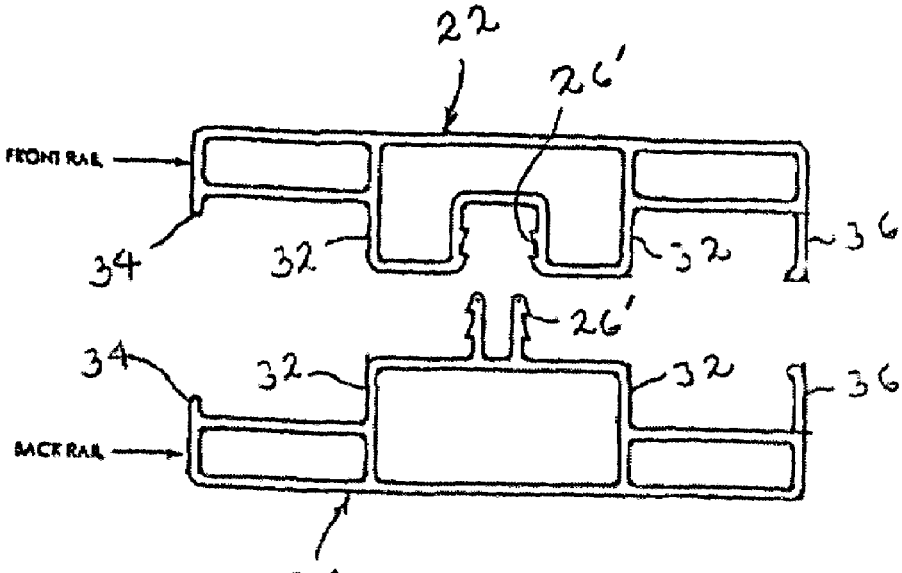
FIG. 17 is an end view of a modified rail construction.
Figure 18:
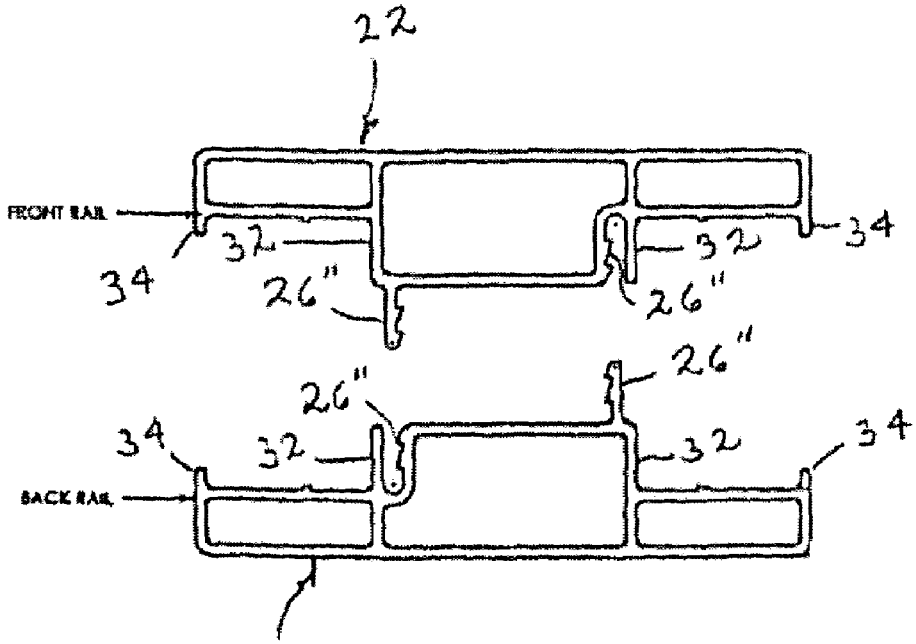
FIG. 18 is an end view of another modified construction of the rail of this invention.

Each of the rails 12, 14 and 16 are formed into two half parts 22 and 24. Except for the fasteners 26 which connect the half parts, one half part 22 is essentially a mirror image of the other half part 24. As best illustrated in FIGS. 5 and 10, each rail half part 22 and 24 includes an intermediate longitudinal portion which accommodates boards 20 and which is formed with outer edges 28, 30, each having a flange 32 spaced inwardly from the upper and lower edges. Overlying flanges 32 are longitudinally spaced ribs 34 which for each rail half part, 22, 24 protrude inwardly from one of the outer edges 28, 30. Ribs 34 forms spacers which separate boards 20 as they extend between the rails. The remaining outer edge 28, 30 of each rail half part 22, 24 is formed, preferably, into an uninterrupted flange 36 which parallels the underlying adjacent flange 32. As will be explained later, in some forms of this construction, flange 36 could also be formed into longitudinally spaced ribs of 34 depending upon the intended construction of the fence. Fasteners 26 form a part of flanges 32 which, when the two half parts are mated or pressed together, form an interfering fit between the half parts, thus forming the rail. The manner and form of fasteners 26 can vary which is shown in FIG. 17 illustrative of a different form of fasteners 26' and in FIG. 18 in which fasteners 26' are illustrated.

With half parts 22, 24 of each rail 12, 14 and 16 joined by their respective fasteners 26, ribs 34 confront one another to form a space 40 between the paired adjacent ribs. This space 40 provides an opening into which a board 20 is fitted with the confronting ribs 34 forming a spacer 41 between the boards. At each end portion of each rail half part 22, 24 of intermediate rail 14, flanges 32 and 36 as well as ribs 34 have been removed or notched at 50 to accommodate the end posts 18. For bottom rail 12 and top rail 16, flange 36 is not notched at the end portions, although flanges 32 and ribs 34 have been removed at the end portions 51 which not only accommodates the end posts 18, but allows flanges 36 of half parts 22, 24 to overlie the top or bottom of the end post 18 as the case may be in an abutting relationship so to provide a covering face at the upper and lower edges of the fence. (See FIGS. 2 and 4). The cutout portions 50, 51 of each rail half part 22, 24 accommodates end posts 18 when the two half parts are joined and interlocked together by their respective fasteners 26.

Figures 2, 3, 4:
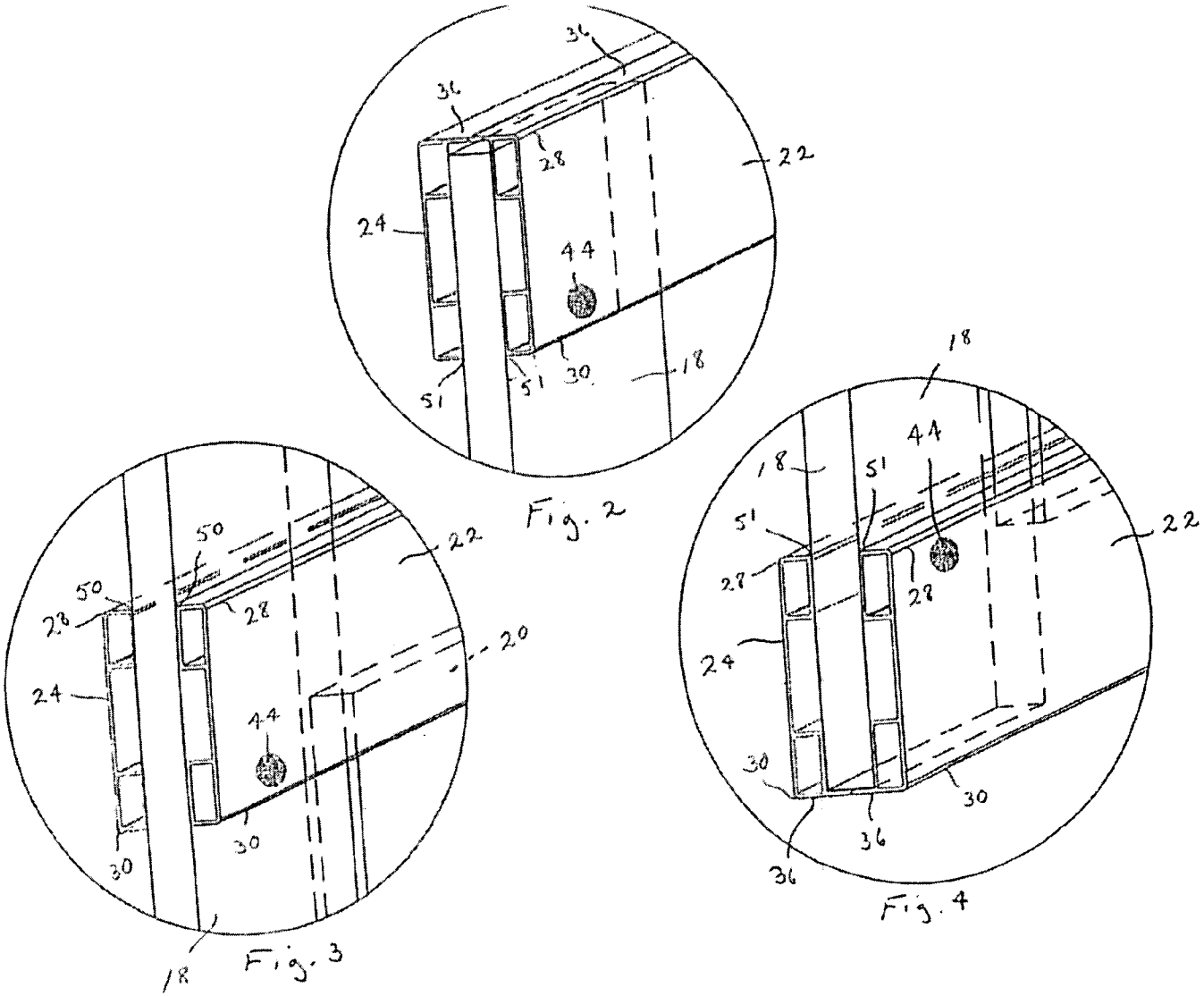
FIG. 2 is a detailed perspective view of that portion of FIG. 1 within circle 2.
FIG. 3 is a detailed perspective view of that portion of FIG. 1 within circle 3.
FIG. 4 is a detailed perspective view of that portion of FIG. 1 within circle 4.
Figure 8:
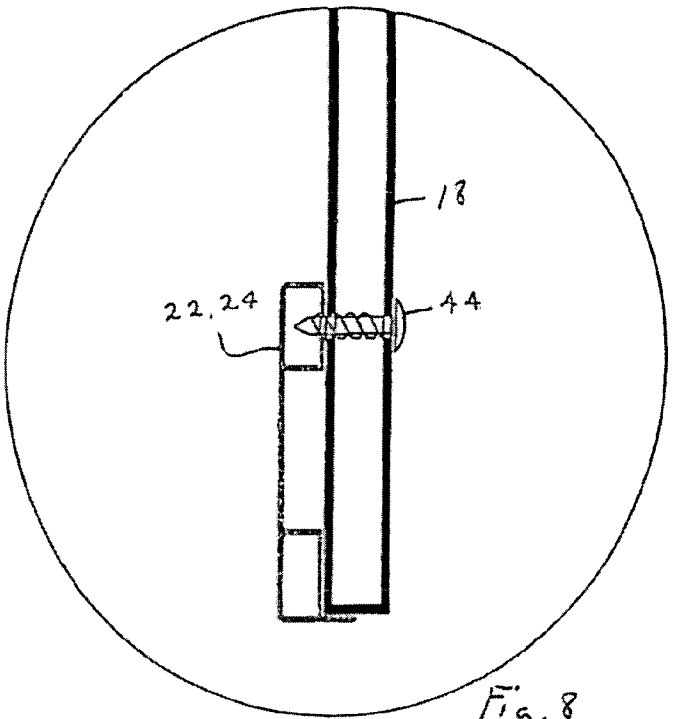
FIG. 8 is a sectional view taken through line 8—8 of FIG. 7.
Figure 7:
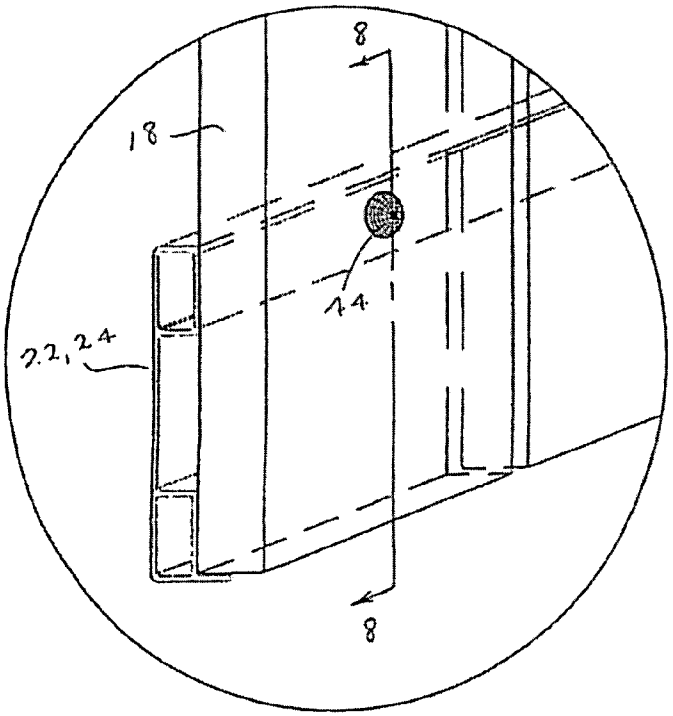
FIG. 7 is a detailed view similar to FIG. 4 but illustrative of a modified embodiment in which a single half part is utilized as the bottom rail of the fence.
Figure 9:
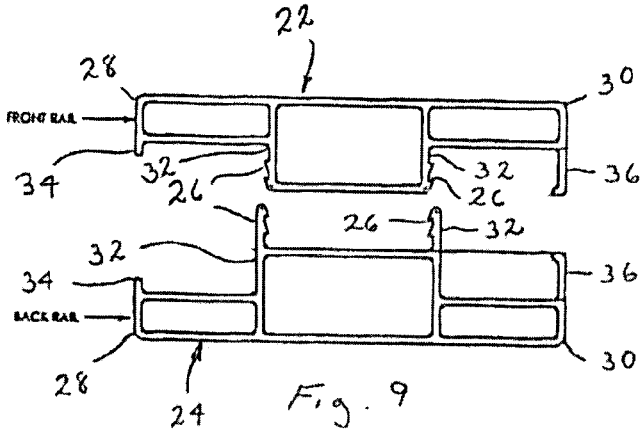
FIG. 9 is an end view of the rails utilized for the fence of FIG. 1 showing with the half parts thereof in separated form.

It is best illustrated in FIGS. 2–4, the end posts are connected to the joined rail half parts 22, 24 by screw fasteners 44, which are turned through the half part and into the adjacent end post. The boards 20 which extend between rails 12 and 14 are spaced apart by ribs 34 with the bottom end of the boards resting upon a flange 32 of the adjoining half parts 22, 24 of bottom rail 12. FIGS. 7 and 8 depict only a single half part 22,24 attached by fastener 44 to the end post 18.

Figure 12:
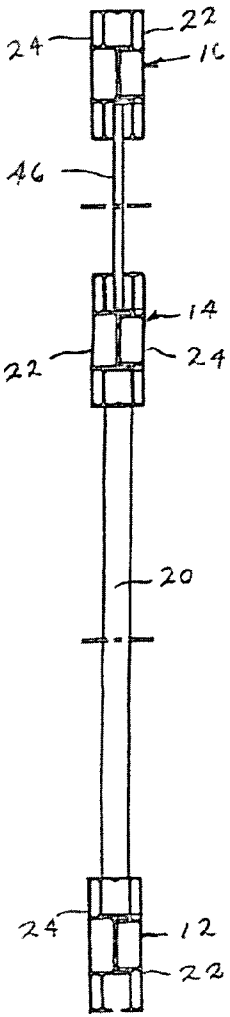
FIG. 12 is a vertical sectional view of a fence of FIG. 11.
Figure 11:
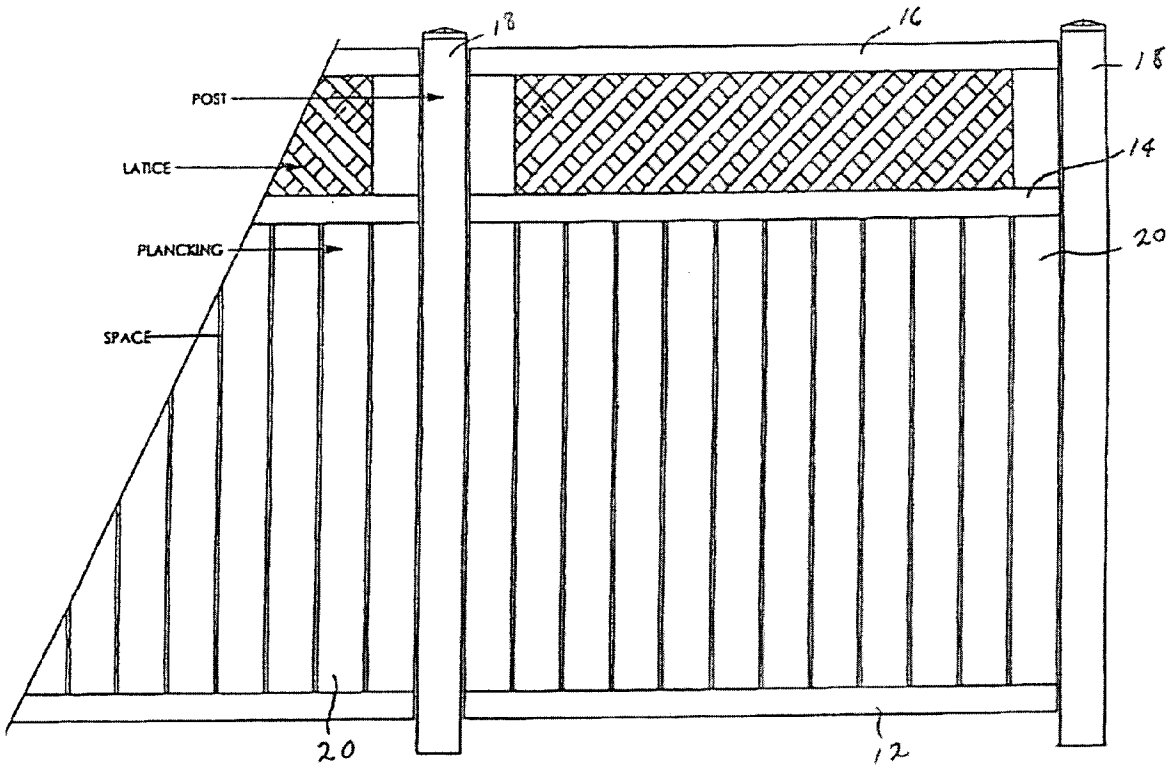
FIG. 11 is a partial elevational view of a fence construction embodying the components of this invention and shown in a modified form.
Figure 14:
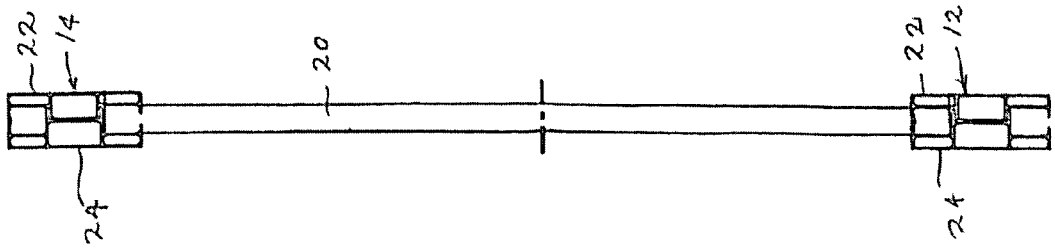
FIG. 14 is a vertical sectional view of a fence of FIG. 13.
Figure 13:
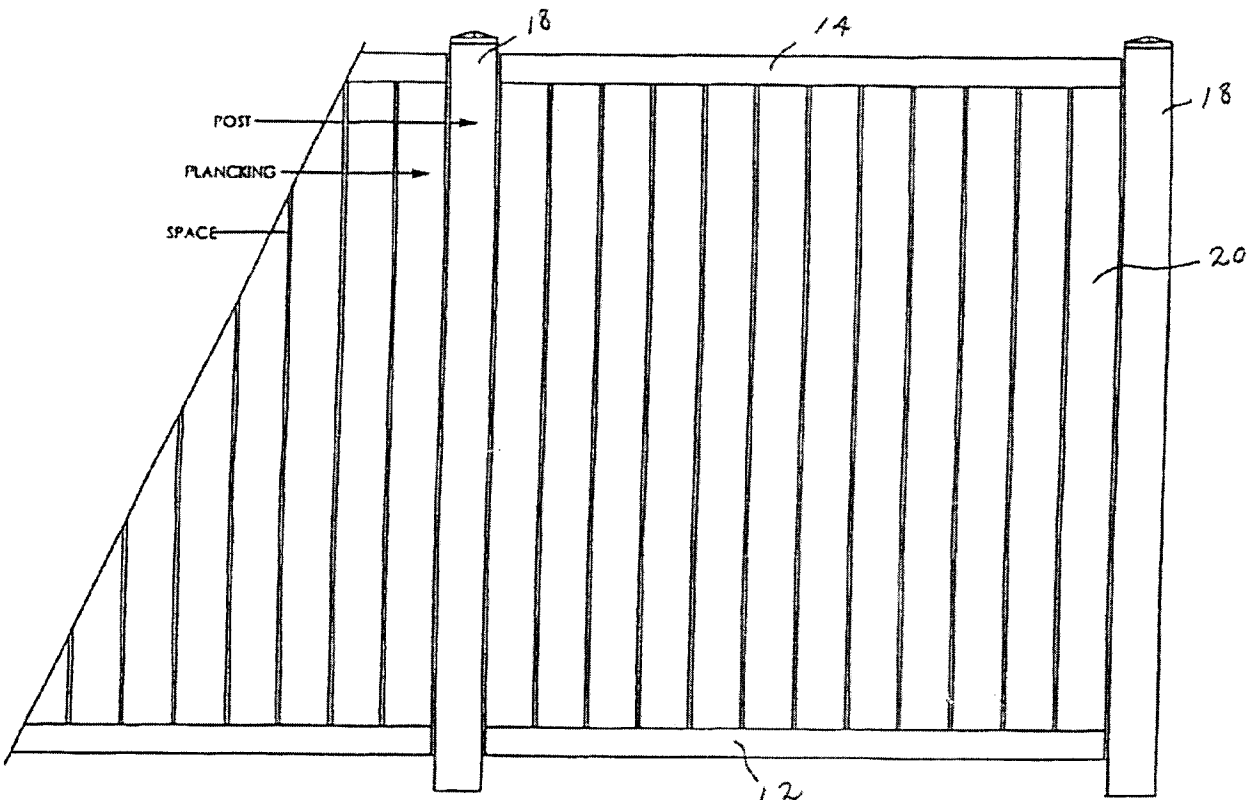
FIG. 13 is a partial elevational view of another embodiment utilizing the component parts of the invention.
Figure 16:
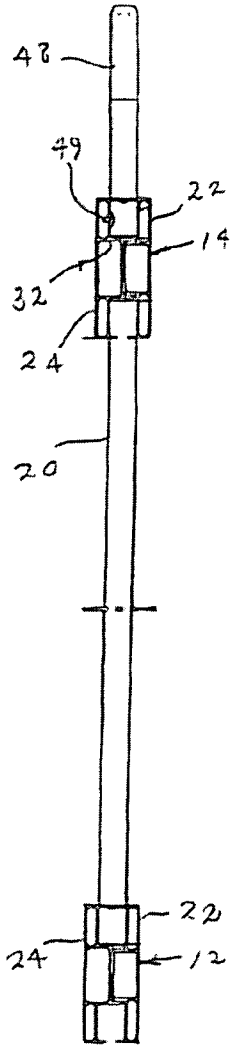
FIG. 16 is a vertical sectional view of the fence of FIG. 15.
Figure 15:
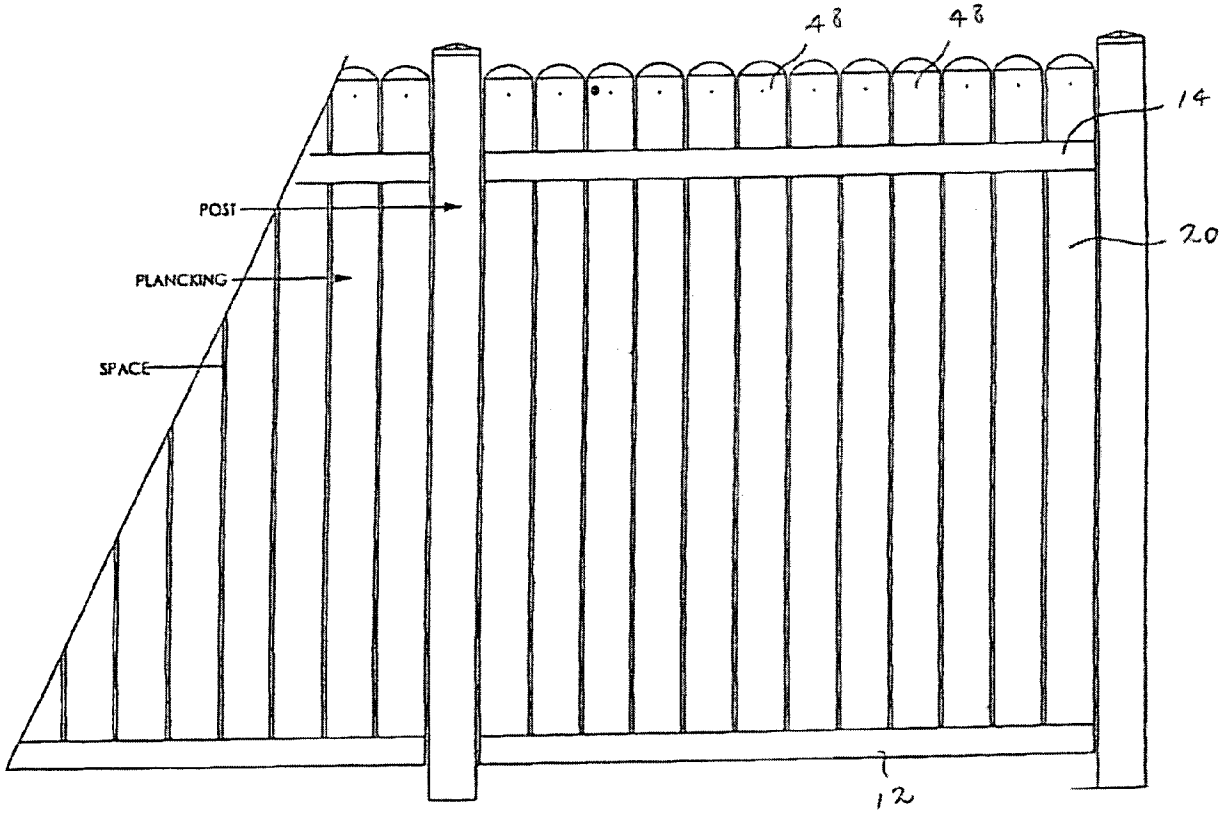
FIG. 15 is partial elevational view of still another embodiment of this invention utilizing the components thereof.

FIGS. 11 and 12 depict a modified embodiment of this invention in which a lattice work 46 has been inserted between rails 14 and 16 of the fence of the FIG. 1. This is accomplished by cutting or deleting the ribs 34, and depending upon the thickness of the lattice work, reducing the middle longitudinal portion of each of the attached half part 22, 24 of the rails so as to permit the lattice work to be fitted at its upper and lower marginal edges between the connected half parts, as best seen in FIG. 12. FIGS. 13 and 14 are illustrative of yet another embodiment of this invention in which the top rail 16 and the extended parts of the end posts 18 have been eliminated with only two rails 12 and 14 being utilized to contain the extending boards 20. FIGS. 15 and 16 are illustrated as still another embodiment of this invention in which extensions 48 of the boards 20 are inserted into rail 14 with its uppermost flanges 36 having been removed to accommodate the post extensions which rest upon the adjacent underlying flange 32. The posts are held by screw fasteners 49 which extend into the half part 24 of rail 14 and the extensions.

The component parts of this invention are preferably formed from extruded plastic. This provides for an economical, durable, and easily maintained product.

The invention is not to be limited by the details above given, but may be modified within the scope of the appended claims.

I claim:

1. A fence comprising an upper horizontal rail, a lower horizontal rail, boards extending between said rails, at least one of said rails having a separate half parts, each of said parts including a cooperating fastener for securing the parts together about said boards, at least one of said parts having longitudinally spaced ribs, said ribs extending in the same direction, each adjacent pair of said ribs defining a space therebetween, and a said board fitted into a said space with said parts secured together about said boards.

2. The fence of claim 1 wherein both of said parts have said longitudinally spaced ribs, said ribs of one of said parts being opposed to said ribs of the other of said parts when said parts are secured together with each adjacent pair of opposed ribs defining a said space therebetween.

3. The fence of claim 1 and a first vertical post extending transversely relative to said rails, said rails engaging said first post.

4. The fence of claim 3 and a second vertical post extending transversely relative to said rails, said rails engaging said second post.

5. The fence of claim 4 wherein each post fits between said parts of each of said rails.

6. The fence of claim 4 and a third horizontal rail located above said upper horizontal rail, each of said rails engaging said first and second vertical posts.

7. The fence of claim 6 wherein said third rail has separate half parts, each of said parts of said third rail including cooperating fasteners for securing the parts together.

8. The fence of claim 7 wherein at least one of said parts of said third rail includes longitudinally spaced ribs, each adjacent pair of ribs defining a space therebetween, a said board fitted into a said space defined between said ribs.

9. The fence of claim 4 wherein each post fits between said opposing half parts of each of said rails.

10. The fence of claim 9 wherein said lower rail carries said posts and said boards.

11. The fence of claim 1 wherein both of said rails have said separate half parts, at least of one of said parts of each rail having said longitudinally spaced ribs.

12. A fence comprising an upper horizontal rail, a lower horizontal rail, boards extending between said rails, at least one of said rails having a separate opposing half parts, each of said parts including a complimentary part of a cooperating fastener for securing the parts together about said boards, at least one of said parts having longitudinally spaced ribs, said ribs extending in the same direction, each adjacent pair of said ribs defining a space therebetween, and a said board fitted into a said space with said parts secured together about said boards.

13. The fence of claim 12 wherein said complimentary parts of said fastener are slidingly engageable in one direction for mechanically preventing disengagement in the opposite direction.

14. The fence of claim 13 wherein said half parts vertically oppose each other, said fastener for securing the parts about opposite sides of said boards.

15. The fence of claim 14 wherein said ribs extend transversely between said parts.

16. The fence of claim 15 wherein said opposing parts and each adjacent pair of said ribs define said space.

17. A fence comprising an upper horizontal rail, a lower horizontal rail, and boards extending between said rails; one of said rails divided into two vertically opposing half parts; each said part including a complimentary portion of a fastener for securing the parts together about opposite sides of said board; one of said parts including a plurality of longitudinally spaced, transverse ribs extending in the same direction toward the other of the parts; said opposing parts and each adjacent pair of said ribs defining a space therebetween into which a said board is fitted when said parts are secured together about said opposite sides of the board.

* * * * *